US007846636B2

(12) United States Patent
Ishikawa

(10) Patent No.: US 7,846,636 B2
(45) **Date of Patent: *Dec. 7, 2010**

(54) PROCESS FOR PRODUCING TONER FOR ELECTROPHOTOGRAPHY

(75) Inventor: Kazuhiro Ishikawa, Wakayama (JP)

(73) Assignee: Kao Corporation, Tokyo (JP)

( * ) Notice: Subject to any disclaimer, the term of this patent is extended or adjusted under 35 U.S.C. 154(b) by 938 days.

This patent is subject to a terminal disclaimer.

(21) Appl. No.: 11/683,031

(22) Filed: Mar. 7, 2007

(65) Prior Publication Data

US 2007/0212628 A1 Sep. 13, 2007

(30) Foreign Application Priority Data

Mar. 10, 2006 (JP) ..... 2006-065776

(51) Int. Cl.
*G03G 5/00* (2006.01)

(52) U.S. Cl. ..... 430/137.14

(58) Field of Classification Search ..... 430/137.14
See application file for complete search history.

(56) References Cited

U.S. PATENT DOCUMENTS 5,849,456 A * 12/1998 Matsumura et al. .... 430/137.18

7,521,166 B2 * 4/2009 Sata et al. ..... 430/137.14

FOREIGN PATENT DOCUMENTS

| | | |
|---|---|---|
| JP | 10-26842 | 1/1998 |
| JP | 2004-12650 | 1/2004 |

* cited by examiner

*Primary Examiner*—Mark A Chapman
(74) *Attorney, Agent, or Firm*—Oblon, Spivak, McClelland, Maier & Neustadt, L.L.P.

(57) ABSTRACT

The present invention relates to a process for readily producing a toner for electrophotography which contains toner particles having a small particle size and a narrow particle size distribution, and a toner for electrophotography having a small particle size and a narrow particle size distribution which is produced by the above process. There is provided a process for producing a toner for electrophotography which includes the steps of (A) finely dispersing a resin binder in an aqueous medium in the presence of a nonionic surfactant to prepare a dispersion of resin binder-containing fine particles; (B) aggregating the resin binder-containing fine particles obtained in the step (A) together to prepare a dispersion of mother particles; (C) adding a dispersion of a resin binder-containing fine particles at one time or sequentially in several divided parts to the dispersion of the mother particles obtained in the step (B) to prepare aggregated particles thereof; and (D) coalescing the aggregated particles obtained in the step (C), as well as a toner for electrophotography which is produced by the above process.

16 Claims, No Drawings

PROCESS FOR PRODUCING TONER FOR ELECTROPHOTOGRAPHY

FIELD OF THE INVENTION

The present invention relates to a process for producing a toner for electrophotography which is employed in electrophotography, an electrostatic recording method, an electrostatic printing method or the like, and a toner for electrophotography produced by the process.

BACKGROUND OF THE INVENTION

Processes for preparing toners for electrophotography include a melt-kneading and pulverization method and a wet process such as an emulsification and aggregation method.

In the conventional techniques for controlling the shape and particle size distribution of toner particles, for example, as the process for readily and simply producing a toner having a high reliability which is capable of stably exhibiting and maintaining various properties such as developing property, transfer property, fixing property and cleaning property, there are disclosed several processes. For example, there is a process for producing a capsule-shaped toner for developing an electrostatic latent image in which a dispersion of fine particles such as colorant particles, inorganic particles and mold release agent particles is added to and mixed with a dispersion of aggregated particles to allow the fine particles to adhere to the aggregated particles (refer to JP 3141783), and a process for producing a toner for developing an electrostatic latent image by allowing aggregated particles obtained by aggregating particles together in a dispersion containing polymer primary particles and a colorant to be fused with each other, wherein primary particles of styrene/butyl acrylate/acrylic acid copolymers are added to fine wax particles as seed particles during an aggregation step thereof (refer to JP 2004-12650A).

SUMMARY OF THE INVENTION

The present invention relates to the following aspects (1) and (2);

(1) A process for producing a toner for electrophotography, comprising the steps of:

(A) finely dispersing a resin binder in an aqueous medium in the presence of a nonionic surfactant to prepare a dispersion of resin binder-containing fine particles;

(B) aggregating the resin binder-containing fine particles obtained in the step (A) together to prepare a dispersion of mother particles;

(C) adding a dispersion of a resin binder-containing fine particles at one time or sequentially in several divided parts to the dispersion of the mother particles obtained in the step (B) to prepare aggregated particles thereof; and (D) coalescing the aggregated particles obtained in the step (C), and (2) A toner for electrophotography which is produced by the process described in the above aspect (1).

DETAILED DESCRIPTION OF THE INVENTION

In application fields of toners for electrophotography, toners have been required to have smaller particle sizes from the viewpoint of achieving even higher image qualities. When a toner containing a resin binder containing a crystalline polyester as a main component is prepared by the melt-kneading and pulverization method, it is difficult to control the pulverization, thereby making it impractical.

On the other hand, when toner particles are produced by the emulsification and aggregation method, it is generally known that as the particle size of the toner is reduced, the particle size distribution thereof becomes broader. Thus, the conventional toners have failed to realize both a smaller particle size and a narrower particle size distribution.

The toner particles obtained in the above conventional techniques all have a particle size as large as about 6 μm and, therefore, fail to achieve sufficient reduction in particle size thereof. Further, the conventional toner particles have failed to satisfy both a small particle size and a narrow particle size distribution.

The present invention relates to a process for readily producing a toner for electrophotography which contains toner particles having a small particle size and a narrow particle size distribution, and a toner for electrophotography having a small particle size and a narrow particle size distribution which is produced by the above process.

The process for producing a toner for electrophotography according to the present invention includes the above steps (A), (B), (C) and (D). The respective steps (A) to (D) are explained below.

[Step (A)]

In the step (A), a resin binder is finely dispersed in an aqueous medium in the presence of a nonionic surfactant to prepare a dispersion of resin binder-containing fine particles.

The resin binder used in the step (A) may be any known resins ordinarily used for toners. Examples of the resin binder include polyesters, styrene-acryl resins, epoxy resins, polycarbonates and polyurethanes. Among these resins, preferred are polyesters and styrene-acryl copolymers, and more preferred are polyesters in view of good dispersibility of colorants therein, good fixing property and good durability. The content of the polyesters in the resin binder is preferably 60% by weight or more, more preferably 70% by weight or more and even more preferably 80% by weight or more.

The polyester contained in the resin binder may be either a crystalline polyester or an amorphous polyester.

As the raw monomers of the polyester, there may be used a known divalent or higher-valent alcohol component and a known carboxylic acid component such as a divalent or higher-valent carboxylic acid and an anhydride and an ester of the carboxylic acid.

Specific examples of the alcohol component include aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol and 1,4-butenediol; aromatic diols such as alkyleneoxide adducts of bisphenol A represented by the general formula (I):

(I)

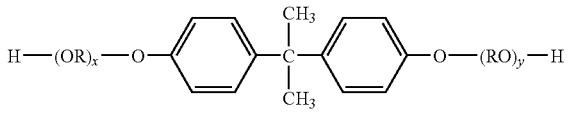

wherein R is an alkylene group having 2 or 3 carbon atoms; and x and y are respectively a positive number showing an average number of moles of alkylene oxides added with the proviso that a sum of x and y is from 1 to 16 and preferably from 1.5 to 5.0, e.g., alkylene ($C_2$ to $C_3$) oxide (average number of moles added: 1 to 16) adducts of bisphenol A such as polyoxypropylene (2.2 mol added)-2,2-bis(4-hydroxyphenyl)propane and polyoxyethylene (2.0 mol added)-2,2-bis(4-hydroxyphenyl)propane; tri- or higher-valent polyhydric alcohols such as glycerol and pentaerythritol. These alcohol components may be used alone or in combination of any two or more thereof.

In the present invention, the content of the alkyleneoxide adduct of bisphenol A represented by the general formula (I) in the alcohol component is preferably 5 mol % or higher, more preferably 50 mol % or higher, even more preferably 80 mol % or higher and most preferably 100 mol %. The content of the aliphatic diol in the whole alcohol components is preferably from 80 to 100 mol % and more preferably from 90 to 100 mol %.

Examples of the carboxylic acid component include aliphatic dicarboxylic acids such as oxalic acid, malonic acid, maleic acid, fumaric acid, citraconic acid, itaconic acid, glutaric acid, succinic acid, adipic acid, sebacic acid, azelaic acid, n-dodecyl succinic acid and n-dodecenyl succinic acid; alicyclic dicarboxylic acids such as cyclohexanedicarboxylic acid; aromatic dicarboxylic acids such as phthalic acid, isophthalic acid and terephthalic acid; trivalent or higher-valent polycarboxylic acids such as trimellitic acid and pyromellitic acid; and anhydrides and alkyl ($C_1$ to $C_3$) esters of these acids. In the following descriptions, the above acids, acid anhydrides and acid alkyl esters are totally referred to as "carboxylic acid compounds". These carboxylic acid components may be used alone or in combination of any two or more thereof.

The content of the aromatic dicarboxylic acid compound or the alicyclic dicarboxylic acid compound in the whole carboxylic acid components is preferably from 80 to 100 mol % and more preferably from 90 to 100 mol % in view of good chargeability and good durability of the resultant toner.

Among them, in the preferred embodiment, terephthalic acid is used as the carboxylic acid component, and the content of terephthalic acid in the whole carboxylic acid components is preferably from 80 to 100 mol % and more preferably from 90 to 100 mol %.

The polyester preferably contains an acid group bonded to a terminal end of a molecular chain thereof. Examples of the acid group include a carboxyl group, a sulfonic group, a phosphonic group and a sulfinic group. Among these acid groups, in view of achieving both good emulsification of the resin and good environmental resistance of a toner produced using the polyester resin, preferred is a carboxyl group. The amount of the acid groups bonded to a terminal end of a molecular chain of the polyester is an important factor for attaining good stability of emulsified particles and determining the particle size distribution and particle size of the resulting toner. In order to stabilize the emulsified particles and obtain a toner having a small particle size and a sharp particle size distribution, the amount of the acid groups bonded to a terminal end of a molecular chain of the polyester is preferably from 0.015 to 0.9 mmol, more preferably from 0.08 to 0.85 mmol, even more preferably from 0.15 to 0.8 mmol and even more preferably from 0.25 to 0.75 mmol per 1 g of the polyester.

The acid value of the polyester is, for example, preferably from 1 to 50 mg KOH/g, more preferably from 5 to 48 mg KOH/g, even more preferably from 10 to 45 mg KOH/g and even more preferably from 15 to 40 mg KOH/g in order to stabilize the emulsified particles and to obtain a toner having a small particle size and a sharp particle size distribution.

Also, if required, a carboxyl group may be introduced into a main molecular chain of the polyester by using the carboxylic acid component composed of a polyvalent acid such as trimellitic acid and the alcohol component composed of a polyhydric alcohol such as pentaerythritol. The amount of the acid group contained in the main molecular chain of the polyester is preferably 5 mol % or less, more preferably 3 mol % or less and even more preferably 1 mol % or less on the basis of the number of moles of the whole carboxylic acid components constituting the polyester.

From the same viewpoints as described above, the molar ratio of the acid groups contained in the main molecular chain of the polyester to the acid groups bonded to the terminal end of the molecular chain of the polyester (moles of acid groups contained in main molecular chain of polyester/moles of acid groups bonded to terminal end of molecular chain of polyester) is preferably 30 mol % or less, more preferably 20 mol % or less, even more preferably 10 mol % or less, even more preferably 5 mol % or less and even more preferably 2 mol % or less.

The amount of the acid groups contained in the main molecular chain of the polyester and the acid groups bonded to the terminal end of the molecular chain of the polyester may be respectively calculated from the structures of the raw acid and the raw alcohol of the polyester, the ratio between these raw components charged, the number-average molecular weight of the polyester, and the measurement of the acid value of the polyester. In addition, the amount of these acid groups may be determined by using the measurement of the acid value of the polyester in combination with a nuclear magnetic resonance spectroscopic method (NMR) or photoelectric spectroscopic method (XPS, ESCA, etc.).

The content of the polyester in the toner is preferably 60% by weight or higher, more preferably 70% by weight or more and even more preferably from 80 to 95% by weight.

The polyester may be produced, for example, by polycondensing the alcohol component and the carboxylic acid component in an inert gas atmosphere at a temperature of about 180 to 250° C., if required, by using an esterification catalyst.

The melting point of the crystalline polyester is preferably from 60 to 150° C., more preferably from 60 to 130° C. and even more preferably from 60 to 120° C. in view of good low-temperature fixing property. The softening point of the amorphous polyester is preferably from 95 to 160° C., and the glass transition point thereof is preferably from 50 to 75° C.

The number-average molecular weight of the crystalline polyester is preferably from 2,000 to 100,000, more preferably from 2,000 to 20,000, even more preferably from 2,000 to 10,000 and even more preferably from 2,000 to 8,000 in view of good emulsifiability, good fixing property and good offset resistance.

The number-average molecular weight of the amorphous polyester is preferably from 1,000 to 100,000, more preferably from 1,000 to 50,000 and even more preferably from 1,000 to 12,000 in view of good durability and good fixing property.

The number-average molecular weight of the polyester may be determined by a gel permeation chromatography using polystyrene as a standard sample.

The resin binder-containing fine particles contained in the dispersion obtained in the step (A) preferably contain a colorant. The colorant is not particularly limited, and may be appropriately selected from known colorants according to applications and purposes thereof. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue, Phthalocyanine Green and Malachite Green Oxalate; and various dyes such as Acridine dyes, Xanthene dyes, azo dyes, benzoquinone dyes, azine dyes, anthraquinone dyes, indigo dyes, thioindigo dyes, phthalocyanine dyes, Aniline Black dyes, polymethine dyes, triphenyl methane dyes, diphenyl methane dyes, thiazine dyes and thiazole dyes. These colorants may be used alone or in combination of any two or more thereof.

The content of the colorant in the toner is preferably 25 parts by weight or less, more preferably from 0.01 to 10 parts by weight and even more preferably from 3 to 10 parts by weight on the basis of 100 parts by weight of the resin binder in view of good tinting strength and good transparency of the obtained toner images.

Further, the fine particles may also contain appropriate additives such as a mold release agent, a charge controlling agent, a conductivity modifier, an extender pigment, a reinforcing filler such as fibrous substances, an antioxidant and an anti-aging agent.

Specific examples of the mold release agent include low-molecular weight polyolefins such as polyethylene, polypropylene and polybutene; silicones; fatty acid amides such as oleamide, erucamide, ricinoleamide, and stearamide; vegetable waxes such as carnauba wax, rice wax, candelilla wax, haze wax and jojoba oil; animal waxes such as beeswax; mineral and petroleum waxes such as montan wax, ozokerite, ceresin, paraffin wax, microcrystalline wax and Fischer-Tropsch wax; and the like. These mold release agents may be used alone or in combination of any two or more thereof.

Examples of the charge controlling agent include chromium-based azo dyes, iron-based azo dyes, aluminum-based azo dyes and metal complexes of salicylic acid.

The content of the charge controlling agent in the toner is preferably 10 parts by weight or less and more preferably from 0.01 to 5 parts by weight on the basis of 100 parts by weight of the resin binder.

In the step (A), the resin binder is finely dispersed in an aqueous medium in the presence of a nonionic surfactant to prepare a dispersion of the resin binder-containing fine particles, i.e., a dispersion of primary particles.

When the resin binder is mixed with the nonionic surfactant, the obtained mixture exhibits a low viscosity, thereby enabling the resin binder to be formed into fine particles. Although not wanting to be limited by theory, the present inventors have found that the reduction in viscosity of the mixture is caused owing to the decrease in apparent softening point of the resin by compatilizing the resin binder with the nonionic surfactant. By utilizing this phenomenon, the apparent softening point of the resin binder compatilized with the nonionic surfactant can be decreased to a boiling point of water or lower. As a result, even the resin binder having a melting point or a softening point of 100° C. or higher as that of the resin solely may be formed into a water dispersion thereof by dropping water thereto under normal pressure. This method may be carried out in the presence of at least water and the nonionic surfactant and is therefore applicable to resins that are insoluble in an organic solvent. In addition, the above method needs neither facilities for recovering the organic solvent and maintaining working environments nor special equipments, resulting in such an advantage that the resin dispersion can be produced in an economical manner. Therefore, although the aqueous medium may contain a solvent such as an organic solvent, the content of water in the aqueous medium is preferably 95% by weight or more and more preferably 97% by weight or more. Thus, in the present invention, the resin binder may be formed into fine particles using water solely and using substantially no organic solvent.

Examples of the nonionic surfactant include polyoxyethylene alkyl aryl ethers or polyoxyethylene alkyl ethers such as polyoxyethylene nonylphenyl ether, polyoxyethylene oleyl ether and polyoxyethylene lauryl ether; polyoxyethylene sorbitan esters such as polyoxyethylene sorbitan monolaurate and polyoxyethylene sorbitan monostearate; polyoxyethylene fatty acid esters such as polyethylene glycol monolaurate, polyethylene glycol monostearate and polyethylene glycol monooleate; and oxyethylene/oxypropylene block copolymers. In the present invention, these nonionic surfactants may be used alone or in combination of any two or more thereof. The nonionic surfactant may be used in combination with an anionic surfactant or a cationic surfactant unless the use thereof adversely affects the effects of the present invention.

The nonionic surfactant is preferably selected from those having good compatibility with the resin used in the toner. In order to obtain a stable dispersion of the resin binder, the nonionic surfactant preferably has an HLB value of 12 to 18. Also, two or more kinds of nonionic surfactants which are different in HLB value from each other are preferably used depending upon the kind of resin binder used. For example, when using the resin having a high hydrophilicity, the use of at least one kind of nonionic surfactant having an HLB value of 12 to 18 may be sufficient to obtain a stable dispersion thereof. On the other hand, when using the resin having a high hydrophobicity, the nonionic surfactant having a low HLB value, for example, an HLB value of about 7 to 10, is preferably used in combination with the nonionic surfactant having a high HLB value, for example, an HLB value of 14 to 20 so as to control a weighted mean HLB value of both the nonionic surfactants to 12 to 18. In this case, it is suggested that the nonionic surfactant having an HLB value of about 7 to 10 serves for allowing the resin to become compatilizable therewith, whereas the nonionic surfactant having a higher HLB value serves for stabilizing dispersion of the resin in water.

Also, when using the colorant in combination with the resin binder, the nonionic surfactant is preferably absorbed in the colorant and dispersed in the resin binder. When the HLB value of the nonionic surfactant is controlled to the above specified range, the nonionic surfactant tends to be readily absorbed onto a surface of the colorant, and simultaneously the colorant tends to be present in the resin binder in a more stable state rather than present in the aqueous medium as a colloid dispersion.

The amount of the nonionic surfactant used is preferably 0.5 part by weight or more on the basis of 100 parts by weight of the resin binder in view of decreasing a melting point of the resin binder, and is preferably 10 parts by weight or less, more preferably 5 parts by weight or less, even more preferably 3 parts by weight or less and further even more preferably 2 parts by weight or less on the basis of 100 parts by weight of the resin binder in view of controlling the amount of the residual nonionic surfactant remaining in the toner and allowing the resin binder-containing fine particles to suitably adhere onto the mother particles.

In the step (A), it is preferred that, for example, after a mixture containing the resin binder and the nonionic surfactant, if required, together with the colorant, is stirred, an aqueous medium such as preferably deionized water and distilled water is dropped to the mixture while keeping the reaction system in a uniformly mixed state. Meanwhile, in this case, care should be taken so as not to separate the resin binder compatilized with the nonionic surfactant from water.

The total amount of the aqueous medium used may be determined such that a concentration of solid components in the dispersion of the resin binder-containing fine particles is preferably from 7 to 50% by weight, more preferably 7 to 40% by weight and even more preferably from 10 to 30% by weight in view of good stability of the obtained dispersion of the resin binder-containing fine particles (primary particles) and good handling property of the dispersion in the subsequent step (B). Meanwhile, the solid components include resins and non-volatile components such as the nonionic surfactant.

In the step (A), the particle size of the primary particles formed therein may be controlled by adjusting the amount of the nonionic surfactant added, the agitation power, the feed rate of water added, etc. In the step (A), the feed rate of the aqueous medium added to, for example, the mixture containing the resin binder and the nonionic surfactant is preferably from 0.1 to 50 g/min, more preferably from 0.5 to 40 g/min and even more preferably from 1 to 30 g/min per 100 g of the mixture in view of obtaining uniform primary particles.

Meanwhile, in the case where the resin binder contains an acid group such as a carboxyl group and a sulfonic group, water may be added to the mixture after or while neutralizing a part or whole of the resin binder. By neutralizing the resin binder, the resin used therein can be enhanced in self-emulsifiability, resulting in production of fine and uniform primary particles.

In the present invention, if required, a dispersant may be used for the purposes of reducing a melt-viscosity and a melting point of the resin binder as well as enhancing a dispersibility of the primary particles produced. Examples of the dispersant include water-soluble polymers such as polyvinyl alcohol, methyl cellulose, ethyl cellulose, hydroxyethyl cellulose, carboxymethyl cellulose, sodium polyacrylate and sodium polymethacrylate; anionic surfactants such as sodium dodecylbenzenesulfonate, sodium octadecyl sulfate, sodium oleate, sodium laurate and potassium stearate; cationic surfactants such as laurylamine acetate, stearylamine acetate and lauryltrimethyl ammonium chloride; amphoteric surfactants such as lauryldimethylamine oxide; and inorganic salts such as tricalcium phosphate, aluminum hydroxide, calcium sulfate, calcium carbonate and barium carbonate. The amount of the dispersant used is preferably 20 parts by weight or less, more preferably 15 parts by weight or less and even more preferably 10 parts by weight or less on the basis of 100 parts by weight of the resin binder in view of good emulsification stability and good washability.

The volume-median particle size ($D_{50}$) of the resin binder-containing fine particles is preferably from 0.05 to 2 μm, more preferably from 0.05 to 1 μm and even more preferably from 0.05 to 0.5 μm in view of uniformly aggregating the particles in the subsequent step (B).

[Step (B)]

In the step (B), the resin binder-containing fine particles obtained in the step (A) are aggregated together to prepare a dispersion of mother particles.

In the step (B), the concentration of solid components in the reaction system upon aggregating the resin binder-containing fine particles may be controlled by adding an additional amount of the aqueous medium to the dispersion of the resin binder, if required, and is preferably controlled to from 5 to 50% by weight, more preferably from 5 to 30% by weight and even more preferably from 5 to 20% by weight in order to allow the resin binder-containing fine particles to be uniformly aggregated together.

The pH of the reaction system in the step (B) is preferably from 2 to 10, more preferably from 2 to 8 and even more preferably from 3 to 7 in view of satisfying both a dispersion stability of the mixed solution and an aggregating property of the primary particles.

From the same viewpoints as described above, the temperature of the reaction system in the step (B) is preferably not lower than the temperature which is lower by 100° C. than the softening point of the resin binder (softening point of the resin binder −(minus) 100° C.) and more preferably not lower than the temperature which is lower by 90° C. than the softening point (softening point of the resin binder −(minus) 90° C.). In order to uniformly aggregate the resin binder-containing fine particles added in the subsequent step with the mother particles, the step (B) is preferably conducted at a relatively low temperature. From such a viewpoint, the temperature of the reaction system in the step (B) is preferably not higher than the temperature which is lower by 10° C. than the softening point of the resin binder (softening point of the resin binder −(minus) 10° C.), more preferably not higher than the temperature which is lower by 20° C. than the softening point (softening point of the resin binder −(minus) 20° C.), even more preferably not higher than the temperature which is lower by 40° C. than the softening point (softening point of the resin binder −(minus) 40° C.) and even more preferably not higher than the temperature which is lower by 50° C. than the softening point (softening point of the resin binder −(minus) 50° C.).

In the step (B), in order to effectively carry out the aggregation, an aggregating agent is preferably added. As the organic aggregating agent, a cationic surfactant in the form of a quaternary salt, polyethyleneimine, or the like may be used, and as the inorganic aggregating agent, an inorganic metal salt, an inorganic ammonium salt, a divalent or higher-valent metal complex or the like may be used. The inorganic metal salt includes, for example, metal salts such as sodium sulfate, sodium chloride, calcium chloride, calcium nitrate, barium chloride, magnesium chloride, zinc chloride, aluminum chloride and aluminum sulfate; and inorganic metal salt polymers such as poly(aluminum chloride), poly(aluminum hydroxide) and poly(calcium sulfide). Examples of the inorganic ammonium salt include ammonium sulfate, ammonium chloride and ammonium nitrate. Among these aggregating agents, ammonium sulfate is preferred in view of a good aggregating capability.

The amount of the aggregating agent used may be appropriately controlled in view of a good aggregating property and good environmental resistance of the resultant toner. When the aggregation step is conducted at a relatively low temperature, the aggregating agent is preferably used in a relatively large amount. The amount of the aggregating agent used is preferably 40 parts by weight or less, more preferably from 1 to 30 parts by weight and even more preferably from 3 to 25 parts by weight on the basis of 100 parts by weight of the solid components contained in the dispersion of the resin binder-containing fine particles.

The aggregating agent is preferably added in the form of an aqueous solution prepared by dissolving the aggregating agent in the aqueous medium, and the resultant mixture is preferably sufficiently stirred during and after addition of the aggregating agent.

Thus, the fine particles contained in the dispersion of the resin binder-containing fine particles are aggregated together to prepare a dispersion of mother particles.

The mother particles contained in the dispersion of the mother particles have a volume-median particle size ($D_{50}$) of preferably 1 to 4 μm, more preferably 1 to 3.5 μm and even more preferably 1 to 3 μm and a variation coefficient of particle size distribution (CV value) of preferably 30% or less, more preferably 25% or less and even more preferably 23% or less in view of reducing the particle size thereof.

Meanwhile, the variation coefficient of particle size distribution (CV value) is the value represented by the following formula:

$$CV\,(\%)=[\text{Standard Deviation of Particle Size of Fine Particles }(\mu m)/\text{Volume Median Particle Size thereof }(\mu m)]\times 100$$

The smaller the CV value, the more narrower the particle size distribution of the fine particles.

[Step (C)]

In the step (C), a dispersion (additional dispersion) of the resin binder-containing fine particles is added at one time or sequentially in several divided parts to the dispersion of the mother particles obtained in the above step (B).

In the step (C), the dispersion of the resin binder-containing fine particles to be added to the dispersion of the mother particles may be produced in the same manner as that obtained in the step (A).

The concentration of solid components contained in the dispersion of the resin binder-containing fine particles is preferably from 7 to 50% by weight, more preferably from 7 to 40% by weight and even more preferably from 10 to 30% by weight in view of good stability and good handling property of the dispersion. The volume median particle size ($D_{50}$) of the fine particles contained in the dispersion is preferably from 0.05 to 2 μm, more preferably from 0.05 to 1 μm and even more preferably from 0.05 to 0.5 μm in view of uniform aggregation of the fine particles with the mother particles.

The resin binder-containing fine particles contained in the dispersion to be added to the dispersion of the mother particles in the step (C) may also appropriately contain, in addition to the resin binder, various additives such as a colorant, a mold release agent, a charge controlling agent, a conductivity modifier, an extender pigment, a reinforcing filler such as fibrous substances, an antioxidant and an anti-aging agent as described in the step (A), if required.

In the present invention, the dispersion of the resin binder-containing fine particles added in the step (C) may be the same as or different from that prepared in the step (A).

In the step (C), the dispersion of the resin binder-containing fine particles is added at one time or sequentially in several divided parts to the dispersion of the mother particles to allow the fine particles to be aggregated with the mother particles. In this case, the total amount of the fine particles contained in the dispersion of the resin binder-containing fine particles to be added is preferably from 15 to 75% by weight and more preferably from 20 to 70% by weight on the basis of the total amount of the resin binder-containing fine particles and the mother particles contained in the dispersion of the mother particles in view of the particle size and an aggregating property of the resultant aggregated particles as well as a coalescing property thereof in the subsequent step.

In the step (C), when the dispersion of the resin binder-containing fine particles is added sequentially in several divided parts, the amount of the fine particles contained in the first part of the dispersion added is preferably from 25 to 45% by weight and more preferably from 25 to 35% by weight on the basis of the weight of the mother particles in view of a good particle size distribution of the resultant aggregated particles, etc. Upon adding the first part of the dispersion of the resin binder-containing fine particles to the dispersion of the mother particles, addition of the aggregating agent thereto is optional. From the same viewpoint as described above, no aggregating agent is preferably added upon addition of the first part of the dispersion.

Also, when the dispersion of the resin binder-containing fine particles is added sequentially in several divided parts, the second or subsequent part of the dispersion of the resin binder-containing fine particles is added along with the aggregating agent, in view of an aggregating property and a particle size distribution of the resultant aggregated particles. In this case, from the same viewpoint, the resin binder-containing fine particles contained in the second or subsequent part of the dispersion and the aggregating agent are preferably added separately from each other but at the same time, or added alternately.

In the present invention, in view of reducing the particle size of the resultant toner particles and achieving a narrow particle size distribution thereof, the dispersion of the resin binder-containing fine particles is preferably added sequentially in several divided parts rather than at one time. More preferably, upon the sequential addition of the several divided parts, the second or subsequent part of the dispersion of the resin binder-containing fine particles is added along with the aggregating agent, and the resin binder-containing fine particles contained in the second or subsequent part of the dispersion and the aggregating agent are added separately from each other but at the same time.

When the dispersion of the resin binder-containing fine particles is added sequentially in several divided parts, the number of the several divided parts of the dispersion is not particularly limited, and is preferably from 2 to 6 and more preferably from 2 to 5 in view of the particle size distribution of the resultant aggregated particles and good workability thereof.

The amount of the aggregating agent used is preferably from 1 to 30 parts by weight, more preferably from 2 to 28 parts by weight and even more preferably from 3 to 25 parts by weight on the basis of 100 parts by weight of the fine particles to be added, in view of reducing the particle size of the resultant toner particles and achieving a narrow particle size distribution thereof. Meanwhile, the details of the aggregating agent used in the step (C) are preferably the same as those described in the step (B) above. The aggregating agent is preferably added in the form of an aqueous solution prepared by dissolving the aggregating agent in the aqueous medium.

In the step (C), when the dispersion of the resin binder-containing fine particles is added sequentially in several divided parts, upon addition of each part, the dispersion of the mother particles is preferably maintained at a temperature of 40 to 60° C., more preferably 40 to 50° C. and even more preferably 43 to 48° C. In addition, in view of the aggregating property and particle size distribution of the resultant aggregated particles, among the several divided parts of the dispersion of the fine particles, at least after adding the first part thereof the obtained mixture is preferably aged for a period of from 5 to 15 min, more preferably from 5 to 30 min and even more preferably from 5 min to 2 h. The obtained mixture is even more preferably aged for the above-specified period after every addition of the several divided parts. Meanwhile, the aging time is preferably the time which elapses from completion of addition of a certain part of the dispersion to initiation of addition of the aggregating agent and/or the dispersion of the resin binder-containing fine particles upon adding the next part of the dispersion.

The thus formed aggregated particles mainly have such a structure in which preferably the fine particles contained in the dispersion of the resin binder-containing fine particles are usually aggregated with and adhere onto a surface of the respective mother particles contained in the dispersion of the mother particles. Meanwhile, in the present invention, the dispersion of the resin binder-containing fine particles obtained by the same method as used in the step (A) may be added to the dispersion of the mother particles obtained in the step (B) to allow the fine particles to be aggregated with the mother particles, or a dispersion of the fine particles separately prepared by the other methods, etc., may be mixed with the dispersion of the mother particles to allow the fine particles to be aggregated with the mother particles.

In the step (C), when adding the respective several divided parts of the dispersion of the resin binder-containing fine particles and the aggregating agent alternately, the order of addition thereof is optional. However, in view of the well-controlled particle size distribution of the resultant aggregated particles, the first part of the dispersion of the resin binder-containing fine particles is preferably added earlier than the first addition of the aggregating agent.

Further, in the present invention, when adding the dispersion of the resin binder-containing fine particles at one time, the addition of the dispersion may be preferably conducted either once or continuously for a certain period.

[Step (D)]

In the step (D), heating is applied to fuse the aggregated particles obtained in the step (C) or coalesce the particle to toner.

The temperature of the reaction system in the step (D) is preferably not lower than the temperature which is lower by 40° C. than the softening point of the resin binder (softening point of resin binder −(minus) 40° C.) but not higher than the temperature which is higher by 10° C. than the softening point of the resin binder (softening point of resin binder +(plus) 10° C.), more preferably not lower than the temperature which is lower by 35° C. than the softening point of the resin binder (softening point of resin binder −(minus) 35° C.) but not higher than the temperature which is higher by 10° C. than the softening point of the resin binder (softening point of resin binder +(plus) 10° C.), and even more preferably not lower than the temperature which is lower by 30° C. than the softening point of the resin binder (softening point of resin binder −(minus) 30° C.) but not higher than the temperature which is higher by 10° C. than the softening point of the resin binder (softening point of resin binder +(plus) 10° C.) in view of well controlling the particle size, the particle size distribution and the shape of the aimed toner, and fusibility of the particles. In addition, the stirring rate is preferably a rate at which the aggregate particles are not precipitated.

The resultant unified particles may be appropriately subjected to subsequent steps such as a liquid-solid separation step such as filtration, a washing step and drying step according to requirements, thereby obtaining toner particles.

In the washing step, metal ions being present on a surface of the respective toner particles are preferably removed by washing the particles with an acid in order to ensure sufficient chargeability and reliability required as a toner. Further, the nonionic surfactant added is preferably completely removed by the washing step from the resultant toner particles. In this case, the washing of the toner particles is preferably conducted using an aqueous solution at a temperature not higher than a cloud point of the nonionic surfactant. The washing is preferably carried out several times.

In addition, in the drying step, any optional methods such as vibration-type fluidizing drying method, spray-drying method, freeze-drying method and flash jet method can be employed. The water content in the toner particles after drying is preferably adjusted to 1.5% by weight or less and more preferably 1.0% by weight or less in view of good chargeability of the toner.

In accordance with the present invention, there can be obtained toner particles which are suitable for forming images having a high definition and a high quality, and have a spherical shape, a small particle size and a narrow particle size distribution.

The volume median particle size ($D_{50}$) of the toner particles is preferably from 1 to 5 μm, more preferably from 1 to 4 μm and even more preferably from 1 to 3 μm in view of high image quality and productivity. From the same viewpoints, the CV value of the toner particles is preferably 23% or less, more preferably 22% or less and even more preferably 20% or less. In the present invention, the particle size of the toner may be measured by an electric resistance method based on a Coulter Principle, more specifically, may be measured using a Coulter counter. The CV value may be determined by the above-mentioned method. Meanwhile, in the present invention, the "volume median particle size ($D_{50}$)" means such a particle size at which a cumulative volume frequency calculated as a volume percentage when accumulated from the smaller particle size side is 50%.

In addition, the toner particles have a softening point of preferably from 60 to 140° C., more preferably from 60 to 130° C. and even more preferably from 60 to 120° C. in view of good low-temperature fixing property. Further, the toner particles have a maximum peak temperature of an endothermic curve determined by a differential scanning calorimeter of preferably from 60 to 140° C., more preferably from 60 to 130° C. and even more preferably from 60 to 120° C. from the same viewpoint as described above.

In the toner particles obtained by the above process including the steps (A) to (D), an external additive such as a fluidizing agent may be added to treat a surface of the toner particles therewith. As the external additive, there may be used known fine particles, e.g., fine inorganic particles such as fine silica particles whose surface is subjected to a hydrophobic treatment, fine titanium oxide particles, fine alumina particles, fine cerium oxide particles and carbon blacks, and fine particles of polymers such as polycarbonates, polymethyl methacrylate and silicone resins.

The number-average particle size of the external additive is preferably from 4 to 200 nm and more preferably from 8 to 30 nm. The number-average particle size of the external additive may be measured using a scanning type electron microscope or a transmission type electron microscope.

The amount of the external additive blended is preferably from 1 to 5 parts by weight and more preferably from 1.5 to 3.5 parts by weight on the basis of 100 parts by weight of the toner particles before being treated with the external additive. When a hydrophobic silica is used as the external additive, the hydrophobic silica is preferably used in an amount of from 1 to 3 parts by weight on the basis of 100 parts by weight of the toner particles before being treated with the external additive, thereby attaining the aimed effects.

The toner for electrophotography obtained according to the present invention may be used not only as a one-component type developer but also as a two-component type developer in the form of a mixture with a carrier.

Further, in accordance with the present invention, there is also provided a toner for electrophotography which is produced by the above process of the present invention.

According to the production process of the present invention, the toner for electrophotography which contains toner particles having a small particle size and a narrow particle size distribution may be readily produced. In addition, the toner for electrophotography which is produced by the process may also have a small particle size and a narrow particle size distribution.

Thus, in the process for producing a toner for electrophotography according to the present invention, there may be readily produced a toner for electrophotography which contains toner particles having a small particle size and a narrow particle size distribution. The thus obtained toner may be used, for example, as a non-magnetic one-component type developer or a two-component type developer by mixing the toner with a carrier and, therefore, may be suitably employed for developing electrostatic latent images formed by electrophotography, electrostatic recording method, electrostatic printing method or the like.

The present invention is described in more detail by referring to the following examples. However, it should be noted that these examples are only illustrative and not intended to limit the invention thereto.

Various properties of resins, a particle size of fine resin particles and a particle size of a toner were measured by the following methods.

(1) Acid Value of Resins

Determined according to JIS K0070. However, with respect to only a solvent used upon the measurement, the mixed solvent of ethanol and ether as prescribed in JIS K0070 was replaced with a mixed solvent containing acetone and toluene at a volume ratio of 1:1.

(2) Softening Point of Resins

The softening point was determined as the temperature at which half of the amount of a sample flowed out when plotting a downward movement of a plunger against temperature, as measured by using a flow tester "CFT-500D" available from Shimadzu Seisakusho Co., Ltd., in which 1 g of the sample was extruded through a nozzle having a die pore size of 1 mm and a length of 1 mm while heating the sample at a temperature rise rate of 6° C./min and applying a load of 1.96 MPa thereto with the plunger.

(3) Glass Transition Point of Resins

Using a differential scanning calorimeter "DSC 210" available from Seiko Instruments, Inc., a sample was heated to 200° C., cooled from 200° C. to 0° C. at a temperature drop rate of 10° C./min and further heated at a temperature rise rate of 10° C./min to prepare an endothermic curve. The glass transition point of the sample was determined from the endothermic curve as the temperature at which an extension of a base line below the endothermic maximum peak temperature intersects a tangential line having a maximum inclination in a region from the raised-up portion to the apex of the peak in the curve.

(4) Number-Average Molecular Weight of Resins

The number-average molecular weight was calculated from the molecular weight distribution measured by a gel permeation chromatography according to the following method.

(a) Preparation of Sample Solution

The sample was dissolved in tetrahydrofuran such that the resultant solution had a concentration of 0.5 g/100 mL. The obtained solution was then filtered through a fluororesin filter ("FP-200" commercially available from Sumitomo Electric Industries, Ltd.) having a pore size of 2 μm to remove insoluble components from the solution, thereby obtaining a sample solution.

(b) Measurement of Molecular Weight Distribution

Tetrahydrofuran as a solvent was flowed at a rate of 1 mL/min, and a column was stabilized in a thermostat at 40° C. One-hundred microliters of the sample solution was injected to the column to measure a molecular weight distribution of the sample. The molecular weight of the sample was calculated on the basis of a calibration curve previously prepared. The calibration curve of the molecular weight of the sample was prepared by using several kinds of monodisperse polystyrenes (those having molecular weights of $2.63\times10^3$, $2.06\times10^4$ and $1.02\times10^5$ available from Tosoh Co., Ltd., and those having molecular weights of $2.10\times10^3$, $7.00\times10^3$ and $5.04\times10^4$ available from GL Science Co., Ltd.) as standard samples.

Analyzer: CO-8010 (commercially available from Tosoh Co., Ltd.)

Column: GMHLX+G3000HXL (commercially available from Tosoh Co., Ltd.)

(5) Particle Size of Fine Resin Particles

Measuring Apparatus:

Laser diffraction particle size analyzer "LA-920" available from Horiba Seisakusho Co., Ltd.;

Measuring Conditions:

A measuring cell was filled with distilled water, and a volume median particle size ($D_{50}$) was measured at a concentration of the dispersion at which an absorbance thereof was within a proper range.

(6) Particle Size of Toner

Measuring Apparatus: Coulter Multisizer II (commercially available from Beckman Coulter Inc.)

Aperture Diameter: 50 μm

Analyzing Software: Coulter Multisizer AccuComp Ver. 1.19 (commercially available from Beckman Coulter Inc.)

Measurement Conditions

One-hundred milliliters of an electrolyte and a dispersion were added to a beaker, and particle sizes of 30000 particles were measured at such a concentration capable of measuring the particle sizes of 30000 particles for 20 seconds, to determine a volume median particle size ($D_{50}$) thereof. Further, the CV value was calculated according to the following formula:

$$CV\text{ value }(\%)=(\text{Standard Deviation of Particle Size Distribution}/\text{Volume median particle size})\times100$$

Production Example 1 for Resin

In a nitrogen atmosphere, 8320 g of polyoxypropylene (2.2 mol added)-2,2-bis(4-hydroxyphenyl)propane, 80 g of polyoxyethylene (2.0 mol added)-2,2-bis(4-hydroxyphenyl)propane, 1592 g of terephthalic acid, and 32 g of dibutyl tin oxide as an esterification catalyst were reacted with each other under normal pressures at 230° C. for 5 h, and further reacted under reduced pressure. After the obtained reaction product was cooled to 210° C., 1672 g of fumaric acid and 8 g of hydroquinone were added to react therewith for 5 h, and further the reaction was conducted under reduced pressure, thereby obtaining a polyester resin A. The polyester resin A had a softening point of 110° C., a glass transition temperature of 66° C., an acid value of 24.4 mg KOH/g and a number-average molecular weight of 3760. One kilogram of the obtained polyester resin A was passed through a sieve having an opening diameter of 5.6 mm. As a result, it was confirmed that no residue on the sieve remained.

Production Example 2 for Resin

A four-neck flask equipped with a nitrogen inlet tube, a dehydration tube, a stirrer, and a thermocouple was charged with 17500 g of polyoxypropylene (2.2 mol added)-2,2-bis(4-hydroxyphenyl)propane, 16250 g of polyoxyethylene (2.0 mol added)-2,2-bis(4-hydroxyphenyl)propane, 11454 g of terephthalic acid, 1608 g of dodecenyl succinic anhydride, 4800 g of trimellitic anhydride and 15 g of dibutyl tin oxide, and the contents of the flask were reacted with each other at 220° C. while stirring under a nitrogen atmosphere until the softening point reached 120° C. as measured according to ASTM D36-86, thereby obtaining a polyester resin B. The polyester resin B had a softening point of 121° C., a glass transition temperature of 65° C., an acid value of 18.5 mg KOH/g and a number-average molecular weight of 3394. One kilogram of the obtained polyester resin B was passed through a sieve having an opening diameter of 5.6 mm. As a result, it was confirmed that no residue on the sieve remained.

Production Example 1 for Master Batch

Seventy parts by weight of a fine powder of the polyester resin A and an aqueous slurry containing a copper phthalocyanine pigment ("ECB-301"; solid (pigment) content: 46.2% by weight) available from Dai-Nichi Seika Co., Ltd., which was used in an amount of 30 parts by weight in terms of the pigment component, were charged into a Henschel mixer, and mixed with each other for 5 min to obtain a wetted mixture. The resultant mixture was charged into a kneader-type mixer and gradually heated. The resin was melted at a temperature of about 90 to 110° C., and the mixture was kneaded under the condition that water was still present therein, and further continuously kneaded at a temperature of 90 to 110° C. for 20 min while evaporating water therefrom.

The resultant kneaded material was continuously kneaded at 120° C. to evaporate a residual water therefrom, and dehydrated and dried, and further continuously kneaded at a temperature of 120 to 130° C. for 10 min. After cooling, the obtained kneaded material was kneaded using a heating triple roll, cooled and coarsely crushed, thereby obtaining a high-concentration colored composition in the form of coarse particles containing the copper phthalocyanine pigment at a concentration of 30% by weight (master batch 1). The resultant composition was placed on a slide glass, and heat-melted. As a result of observing the melted composition using a microscope, it was confirmed that the pigment particles were entirely finely dispersed in the composition, and no coarse particles were present therein. One kilogram of the obtained master batch 1 was passed through a sieve having an opening diameter of 5.6 mm. As a result, it was confirmed that no residue on the sieve remained.

Production Example 2 for Master Batch

One hundred parts by weight of a fine powder of the polyester resin A and 10 parts by weight of a negative charge controlling agent "BONTRONE E-84" available from Orient Chemical Co., Ltd., were melt-kneaded together using a twin-screw kneader "PCM-30" available from Ikegai Co., Ltd., at a feed rate of 10 kg/min, a rotating speed of 200 rpm and a temperature of 100° C., thereby obtaining a coarsely pulverized product (master batch 2) containing the charge controlling agent.

Production Example 1 for Dispersion of Resin-Containing Fine Particles

One hundred sixty grams of the polyester resin A, 105 g of the polyester resin B, 50 g of the master batch 1, 3 g of a nonionic surfactant "EMULGEN 430" available from Kao Corp., 4.62 g of an anionic surfactant "NEOPELEX G-65" available from Kao Corp., and 139.3 g of a 5 wt % potassium hydroxide aqueous solution as a neutralizing agent, were charged into a 5 L stainless steel vessel, and melted for 2 h at 98° C. while stirring with a paddle-shaped stirrer at a rate of 200 rpm, thereby obtaining a resin binder mixture 1. Next, deionized water was dropped in a total amount of 867.7 g to the mixture at a rate of 5 g/min while stirring with the paddle-shaped stirrer at a rate of 300 rpm, thereby preparing a dispersion of resin-containing fine particles. Finally, after cooling to room temperature, the resultant dispersion was passed through a wire mesh having a 200 mesh screen (opening: 105 μm) to obtain a dispersion containing fine resin particles finely dispersed therein. As a result, it was confirmed that the primary particles contained in the resultant dispersion had a volume median particle size ($D_{50}$), of 0.315 μm and a variation coefficient of particle size distribution (CV value) of 24.7%, and no resin components remained on the wire mesh. The thus prepared dispersion of the resin-containing fine particles was controlled in a solid resin content therein to 20% by weight, thereby obtaining a dispersion 1 of the resin-containing fine particles.

Production Example 2 for Dispersion of Resin-Containing Fine Particles

Three hundred grams of the polyester resin A, 3 g of a charge controlling agent "BONTRONE E-84" available from Orient Chemical Co., Ltd., 3 g of a nonionic surfactant "EMULGEN 430" available from Kao Corp., 11.5 g of an anionic surfactant "NEOPELEX G-25" available from Kao Corp., and 146 g of a 5 wt % potassium hydroxide aqueous solution as a neutralizing agent, were charged into a 5 L stainless steel vessel, and melted for 2 h at 98° C. while stirring with a paddle-shaped stirrer at a rate of 200 rpm, thereby obtaining a resin binder mixture 2. Next, deionized water was dropped in a total amount of 539 g to the mixture at a rate of 5 g/min while stirring with the paddle-shaped stirrer at a rate of 200 rpm, thereby preparing a dispersion of resin-containing fine particles. Finally, after cooling to room temperature, the resultant dispersion was passed through a wire mesh having a 200 mesh screen (opening: 105 μm) to obtain a dispersion containing fine resin particles finely dispersed therein. As a result, it was confirmed that the primary particles contained in the resultant dispersion had a volume median particle size ($D_{50}$) of 0.125 μm and a variation coefficient of particle size distribution (CV value) of 23.5%, and no resin components remained on the wire mesh. The thus prepared dispersion of the resin-containing fine particles was controlled in a solid resin content therein to 20% by weight, thereby obtaining a dispersion 2 of the resin-containing fine particles.

Production Example 3 for Dispersion of Resin-Containing Fine Particles

Five hundred and seventy three grams of the polyester resin A, 30 g of the master batch 2, 6 g of a nonionic surfactant "EMULGEN 430" available from Kao Corp., 40 g of an anionic surfactant "NEOPELEX G-15" available from Kao Corp., and 293 g of a 5 wt % potassium hydroxide aqueous solution as a neutralizing agent, were charged into a 5 L stainless steel vessel, and melted for 2 h at 95° C. while stirring with a paddle-shaped stirrer at a rate of 200 rpm, thereby obtaining a resin binder mixture 3. Next, deionized water was dropped in a total amount of 1189 g to the mixture at a rate of 5 g/min while stirring with the paddle-shaped stirrer at a rate of 200 rpm, thereby preparing a dispersion of resin-containing fine particles. Finally, after cooling to room temperature, the resultant dispersion was passed through a wire mesh having a 200 mesh screen (opening: 105 μm) to obtain a dispersion containing fine resin particles finely dispersed therein. As a result, it was confirmed that the primary particles contained in the resultant dispersion had a volume median particle size ($D_{50}$) of 0.138 μm and a variation coefficient of particle size distribution (CV value) of 25.1%, and no resin components remained on the wire mesh. The thus prepared dispersion of the resin-containing fine particles was controlled in a solid resin content therein to 20% by weight, thereby obtaining a dispersion 3 of the resin-containing fine particles.

Production Example 4 for Dispersion of Resin-Containing Fine Particles

Six hundred grams of the polyester resin A, 6 g of a nonionic surfactant "EMULGEN 430" available from Kao Corp., 23 g of an anionic surfactant "NEOPELEX G-25" available from Kao Corp., and 293 g of a 5 wt % potassium hydroxide aqueous solution as a neutralizing agent, were charged into a 5 L stainless steel vessel, and melted for 2 h at 95° C. while stirring with a paddle-shaped stirrer at a rate of 200 rpm, thereby obtaining a resin binder mixture 4. Next, deionized water was dropped in a total amount of 1078 g to the mixture at a rate of 5 g/min while stirring with the paddle-shaped stirrer at a rate of 200 rpm, thereby preparing a dispersion of resin-containing fine particles. Finally, after cooling to room temperature, the resultant dispersion was passed through a wire mesh having a 200 mesh screen (opening: 105 μm) to obtain a dispersion containing fine resin particles finely dispersed therein. As a result, it was confirmed that the primary particles contained in the resultant dispersion had a volume median particle size ($D_{50}$) of 0.12 μm and a variation coefficient of particle size distribution (CV value) of 23.4%, and no resin components remained on the wire mesh. The thus prepared dispersion of the resin-containing fine particles was controlled in a solid resin content therein to 20% by weight, thereby obtaining a dispersion 4 of the resin-containing fine particles.

The results of Production Examples 1 to 4 for resin-containing fine particles are shown together in Table 1 below.

TABLE 1

| | Resin-containing fine particles | | | |
|---|---|---|---|---|
| | Dispersion 1 | Dispersion 2 | Dispersion 3 | Dispersion 4 |
| Polyester resin A (g) | 160 | 300 | 573 | 600 |
| Polyester resin B (g) | 105 | — | — | — |
| Master batch 1 (g) (polyester resin A + pigment) | 50 | — | — | — |
| Master batch 2 (g) (polyester resin A + charge controlling agent) | — | — | 30 | — |
| Charge controlling agent (g) | — | 3 | — | — |
| $D_{50}$ (μm) | 0.315 | 0.125 | 0.138 | 0.120 |
| CV value (%) | 24.7 | 23.5 | 25.1 | 23.4 |

EXAMPLE 1

Six hundred grams of the dispersion 1 of resin-containing fine particles was sampled and charged into a 2 L three-necked separable flask at room temperature. Then, 236 g of a 11.7 wt % ammonium sulfate aqueous solution as an aggregating agent was added to the dispersion while stirring with a paddle-shaped stirrer at a rate of 100 rpm, and the contents of the flask were stirred at room temperature for 10 min. Thereafter, the mixed dispersion was heated from room temperature to 48° C. at a temperature rise rate of 0.3° C./min, and allowed to stand at 48° C. for 2 h, thereby obtaining a dispersion A of mother particles.

Next, 180 g of the dispersion 3 of resin-containing fine particles was dropped at a rate of 9 g/min for 20 min to the dispersion A of mother particles while stirring the dispersion A at 48° C. with the paddle-shaped stirrer at a rate of 100 rpm. After completion of the dropping, the resultant mixed dispersion was allowed to stand at 48° C. for 20 min (volume median particle size ($D_{50}$): 3.78 μm; CV value: 19.8%).

Finally, 422 g of a 2.7 wt % aqueous solution of an anionic surfactant "EMULE E-27C" available from Kao Corp., was added to the obtained dispersion, and the resultant mixture was heated to 87° C. and then allowed to stand at 87° C. for 2 h, thereby obtaining toner particles (volume median particle size ($D_{50}$): 3.72 μm; CV value: 21%). The results are shown in Table 2-1.

EXAMPLE 2

Two hundred grams of the dispersion 1 of resin-containing fine particles was sampled and charged into a 2 L three-necked separable flask at room temperature. Then, 74.7 g of a 11.7 wt % ammonium sulfate aqueous solution as an aggregating agent was added to the dispersion while stirring with a paddle-shaped stirrer at a rate of 100 rpm, and the contents of the flask were stirred at room temperature for 10 min. Thereafter, the mixed dispersion was heated from room temperature to 46° C. at a temperature rise rate of 0.3° C./min, and allowed to stand at 46° C. for 3 h, thereby obtaining a dispersion B of mother particles.

Fifty grams of the dispersion B of mother particles was sampled and charged into a 300 mL three-necked separable flask, and then stirred at 46° C. with the paddle-shaped stirrer at a rate of 100 rpm.

Under the above condition, 15 g of the dispersion 2 of resin-containing fine particles was dropped at a rate of 1 g/min to the dispersion B. Immediately after the dropping, 30 g of the dispersion 2 of resin-containing fine particles and 30 g of a 4.6 wt % ammonium sulfate aqueous solution were dropped to the resultant dispersion at a rate of 1 g/min separately from each other and at the same time, and the obtained dispersion was allowed to stand for 45 min (volume median particle size ($D_{50}$): 2.4 μm; CV value: 21.5%).

Finally, 32.9 g of a 2.7 wt % aqueous solution of an anionic surfactant "EMULE E-27C" available from Kao Corp., was added to the resultant dispersion, and the obtained mixture was heated to 83° C. and then allowed to stand at 83° C. for 3 h, thereby obtaining toner particles (volume median particle size ($D_{50}$): 2.43 μm; CV value: 22.5%). The results are shown in Table 2-1.

EXAMPLE 3

Fifty grams of the dispersion B of mother particles obtained in Example 2 was sampled and charged into a 300 mL three-necked separable flask, and then stirred at 46° C. with a paddle-shaped stirrer at a rate of 100 rpm.

Under the above condition, 15 g of the dispersion 2 of resin-containing fine particles was dropped at a rate of 1 g/min to the dispersion B and allowed to stand for 15 min (Step 1). Next, 15 g of the dispersion 2 of resin-containing fine particles and 15 g of a 4.6 wt % ammonium sulfate aqueous solution were dropped to the above obtained dispersion at a rate of 1 g/min separately from each other but at the same time, and the obtained mixed dispersion was allowed to stand for 15 min (step 2). Successively, the procedure of the step 2 was repeated once more (volume median particle size ($D_{50}$): 2.39 μm; CV value: 21.5%). The results are shown in Table 2-1.

EXAMPLE 4

Fifty grams of the dispersion B of mother particles obtained in Example 2 was sampled and charged into a 300 mL three-necked separable flask, and then stirred at 46° C. with a paddle-shaped stirrer at a rate of 100 rpm.

Under the above condition, 15 g of the dispersion 2 of resin-containing fine particles was dropped at a rate of 1 g/min to the dispersion B and allowed to stand for 15 min (Step 1). Next, 15 g of the dispersion 2 of resin-containing fine particles and 15 g of a 4.6 wt % ammonium sulfate aqueous solution were dropped to the above obtained dispersion at a rate of 1 g/min separately from each other but at the same time, and the obtained mixed dispersion was allowed to stand for 15 min (step 2). Successively, the procedure of the step 2 was repeated three times (volume median particle size ($D_{50}$): 2.81 μm; CV value: 21.5%).

Finally, 41.6 g of a 2.7 wt % aqueous solution of an anionic surfactant "EMULE E-27C" available from Kao Corp., was added to the resultant dispersion, and the obtained mixture was heated to 83° C. and then allowed to stand at 83° C. for 1 h, thereby obtaining toner particles (volume median particle size ($D_{50}$): 2.75 μm; CV value: 21.5%). The results are shown in Table 2-1.

EXAMPLE 5

Fifty grams of the dispersion B of mother particles obtained in Example 2 was sampled and charged into a 300 mL three-necked separable flask, and then stirred at 46° C. with a paddle-shaped stirrer at a rate of 100 rpm.

Under the above condition, 15 g of the dispersion 4 of resin-containing fine particles was dropped at a rate of 1 g/min to the dispersion B and allowed to stand for 15 min (Step 1). Next, 15 g of the dispersion 4 of resin-containing fine particles and 15 g of a 4.6 wt % ammonium sulfate aqueous solution were dropped to the above obtained dispersion at a rate of 1 g/min separately from each other but at the same time, and the obtained mixed dispersion was allowed to stand for 15 min (step 2). Successively, the procedure of the step 2 was repeated three times (volume median particle size ($D_{50}$): 2.24 μm; CV value: 21.3%).

Finally, 46.3 g of a 2.7 wt % aqueous solution of an anionic surfactant "EMULE E-27C" available from Kao Corp., was added to the resultant dispersion, and the obtained mixture was heated to 83° C. and then allowed to stand at 83° C. for 3 h, thereby obtaining toner particles (volume median particle size ($D_{50}$): 2.24 μm; CV value: 22.2%). The results are shown in Table 2-1.

EXAMPLE 6

Fifty grams of the dispersion B of mother particles obtained in Example 2 was sampled and charged into a 300 mL three-necked separable flask, and then stirred at 46° C. with a paddle-shaped stirrer at a rate of 100 rpm.

Under the above condition, 15 g of the dispersion 1 of resin-containing fine particles was dropped at a rate of 1 g/min to the dispersion B and allowed to stand for 15 min (Step 1). Next, 15 g of the dispersion 1 of resin-containing fine particles and 15 g of a 4.6 wt % ammonium sulfate aqueous solution were dropped to the above obtained dispersion at a rate of 1 g/min separately from each other but at the same time, and the obtained mixed dispersion was allowed to stand for 15 min (step 2). Successively, the procedure of the step 2 was repeated three times (volume median particle size ($D_{50}$): 2.71 μm; CV value: 19.3%). The results are shown in Table 2-2.

EXAMPLE 7

Four hundred grams of the dispersion 1 of resin-containing fine particles was sampled and charged into a 2 L three-necked separable flask at room temperature. Then, 157 g of a 11.7 wt % ammonium sulfate aqueous solution as an aggregating agent was added to the dispersion while stirring with a paddle-shaped stirrer at a rate of 100 rpm, and the contents of the flask were stirred at room temperature for 10 min. Thereafter, the mixed dispersion was heated from room temperature to 48° C. at a temperature rise rate of 0.3° C./min, and allowed to stand at 48° C. for 2 h, thereby obtaining a dispersion C of mother particles.

Under the above condition, 120 g of the dispersion 3 of resin-containing fine particles was dropped at a rate of 6 g/min to the dispersion C and allowed to stand for 15 min (Step 1). Next, 120 g of the dispersion 3 of resin-containing fine particles and 120 g of a 4.6 wt % ammonium sulfate aqueous solution were dropped to the above obtained dispersion at a rate of 3 g/min separately from each other but at the same time, and the obtained mixed dispersion was allowed to stand for 15 min (step 2). Successively, the same procedure as in the step 2 was repeated once more except that the retention time was changed to 60 min (volume median particle size ($D_{50}$): 3.29 μm; CV value: 19.6%).

Finally, 411 g of a 2.7 wt % aqueous solution of an anionic surfactant "EMULE E-27C" available from Kao Corp., was added to the resultant dispersion, and the obtained mixture was heated to 89° C. and then allowed to stand at 89° C. for 1 h, thereby obtaining toner particles (volume median particle size ($D_{50}$): 3.29 μm; CV value: 19.8%). The results are shown in Table 2-2.

EXAMPLE 8

Fifty grams of the dispersion B of mother particles obtained in Example 2 was sampled and charged into a 300 mL three-necked separable flask, and then stirred at 46° C. with a paddle-shaped stirrer at a rate of 100 rpm.

Under the above condition, 15 g of the dispersion 2 of resin-containing fine particles was dropped at a rate of 1 g/min to the dispersion B and allowed to stand for 15 min (Step 1). Next, 15 g of the dispersion 1 of resin-containing fine particles was added to the resultant dispersion at one time, and then 15 g of a 4.6 wt % ammonium sulfate aqueous solution were dropped to the obtained mixed dispersion at a rate of 1 g/min, and the obtained mixed dispersion was allowed to stand for 15 min (step 2). Successively, the procedure of the step 2 was repeated three times (volume median particle size ($D_{50}$): 2.54 μm; CV value: 22.7%). The results are shown in Table 2-2.

COMPARATIVE EXAMPLE 1

Fifty grams of the dispersion B of mother particles obtained in Example 2 was sampled and charged into a 300 mL three-necked separable flask, and then stirred at 46° C. with a paddle-shaped stirrer at a rate of 100 rpm. Under the above condition, the resultant dispersion was allowed to stand for 4 h (volume median particle size ($D_{50}$): 1.96 μm; CV value: 24.6%).

Next, 13.8 g of a 2.7 wt % aqueous solution of an anionic surfactant "EMULE E-27C" available from Kao Corp., was added to the dispersion, and the obtained mixture was heated to 85° C. and then allowed to stand at 89° C. for 0.67 h, thereby obtaining toner particles (volume median particle size ($D_{50}$): 2.05 μm; CV value: 26.2%). The results are shown in Table 2-2.

COMPARATIVE EXAMPLE 2

One hundred grams of a dispersion obtained by adjusting a solid resin content of the dispersion 1 of resin-containing fine particles to 20% by weight was sampled and charged into a 1 L three-necked separable flask at room temperature. Then, 35 g of a 11.7 wt % ammonium sulfate aqueous solution as an aggregating agent was added to the dispersion while stirring with a paddle-shaped stirrer at a rate of 100 rpm, and the contents of the flask were stirred at room temperature for 10 min. Thereafter, the mixed dispersion was heated from room temperature to 56° C. at a temperature rise rate of 0.3° C./min, and then allowed to stand at 56° C. for 2.5 h, thereby obtaining a dispersion D of mother particles. Under the same condition, the obtained dispersion was further allowed to stand for 2.5 h (volume median particle size ($D_{50}$): 4.1 μm; CV value: 22.7%). The results are shown in Table 2-2.

TABLE 2-1

| | Examples | | | | |
|---|---|---|---|---|---|
| | 1 | 2 | 3 | 4 | 5 |
| Step (B) | | | | | |
| Dispersion of resin-containing fine particles | D1*a | D1*a | D1*a | D1*a | D1*a |
| Dispersion of mother particles | A | B | B | B | B |

TABLE 2-1-continued

| | Examples | | | | |
|---|---|---|---|---|---|
| | 1 | 2 | 3 | 4 | 5 |
| $D_{50}$ (μm) | 3.38 | 1.83 | 1.83 | 1.83 | 1.83 |
| CV value (%) | 21.8 | 23.0 | 23.0 | 23.0 | 23.0 |
| Step (C): first addition of fine particles | | | | | |
| Amount of mother particles (g) | 120.0 | 7.3 | 7.3 | 7.3 | 7.3 |
| Dispersion of resin-containing fine particles | D3*a | D2*a | D2*a | D2*a | D4*a |
| Amount of fine particles added (g) | 36.0 | 3.0 | 3.0 | 3.0 | 3.0 |
| Amount of aqueous aggregating agent solution*1 | — | — | — | — | — |
| Addition method of dispersion of resin-containing fine particles and aqueous aggregating agent solution | *b | *b | *b | *b | *b |
| Addition time (min) | 20 | 15 | 15 | 15 | 15 |
| Retention time after addition (min) | 20 | — | 15 | 15 | 15 |
| Addition temperature/retention temperature (° C.) | 48 | 46 | 46 | 46 | 46 |
| Step (C): second or subsequent addition of fine particles | | | | | |
| Dispersion of resin-containing fine particles | — | D2*a | D2*a | D2*a | D4*a |
| Amount of fine particles added (g) | — | 6.0 | 3.0 | 3.0 | 3.0 |
| Amount of aqueous aggregating agent solution*1 | — | 30.0 | 15.0 | 15.0 | 15.0 |
| Addition method of dispersion of resin-containing fine particles and aqueous aggregating agent solution | — | *c | *c | *c | *c |
| Addition time (min) | — | 30 | 15 | 15 | 15 |
| Retention time after addition (min) | — | 45 | 15 | 15 | 15 |
| Frequency of addition (times) | — | 1 | 2 | 4 | 4 |
| Total amount of fine particles added (g) | 36.0 | 9.0 | 9.0 | 15.0 | 15.0 |
| $D_{50}$ (μm) | 3.78 | 2.40 | 2.39 | 2.81 | 2.24 |
| CV value (%) | 19.8 | 21.5 | 21.5 | 21.5 | 21.3 |
| Step (D) | | | | | |
| Coalescing temperature (° C.) | 87 | 83 | — | 83 | 83 |
| Coalescing time (h) | 2 | 3 | — | 1 | 3 |
| $D_{50}$ (μm) | 3.72 | 2.43 | — | 2.75 | 2.24 |
| CV value (%) | 21.0 | 22.5 | — | 21.5 | 22.2 |

TABLE 2-2

| | Examples | | | Comparative Examples | |
|---|---|---|---|---|---|
| | 6 | 7 | 8 | 1 | 2 |
| Step (B) | | | | | |
| Dispersion of resin-containing fine particles | D1*a | D1*a | D1*a | D1*a | D1*a |
| Dispersion of mother particles | B | C | B | B | D |
| $D_{50}$ (μm) | 1.83 | 2.68 | 1.83 | 1.83 | 3.40 |
| CV value (%) | 23.0 | 20.7 | 23.0 | 23.0 | 22.5 |
| Step (C): first addition of fine particles | | | | | |
| Amount of mother particles (g) | 7.3 | 80.0 | 7.3 | 7.3 | 20.0 |
| Dispersion of resin-containing fine particles | D1*a | D3*a | D2*a | — | — |
| Amount of fine particles added (g) | 3.0 | 24.0 | 3.0 | — | — |
| Amount of aqueous aggregating agent solution*1 | — | — | — | — | — |
| Addition method of dispersion of resin-containing fine particles and aqueous aggregating agent solution | *b | *b | *b | — | — |
| Addition time (min) | 15 | 20 | 15 | — | — |
| Retention time after addition (min) | 15 | 15 | 15 | 240 | 150 |

TABLE 2-2-continued

| | Examples | | | Comparative Examples | |
|---|---|---|---|---|---|
| | 6 | 7 | 8 | 1 | 2 |
| Addition temperature/retention temperature (° C.) | 46 | 48 | 46 | 46 | 56 |
| Step (C): second or subsequent addition of fine particles | | | | | |
| Dispersion of resin-containing fine particles | D1*a | D3*a | D2*a | — | — |
| Amount of fine particles added (g) | 3.0 | 24.0 | 3.0 | — | — |
| Amount of aqueous aggregating agent solution*1 | 15.0 | 120.0 | 15.0 | — | — |
| Addition method of dispersion of resin-containing fine particles and aqueous aggregating agent solution | *c | *c | *d | — | — |
| Addition time (min) | 15 | 40 | 0/15*3 | — | — |
| Retention time after addition (min) | 15 | 15/60*2 | 15 | — | — |
| Frequency of addition (times) | 4 | 2 | 4 | — | — |
| Total amount of fine particles added (g) | 15.0 | 72.0 | 15.0 | — | — |
| $D_{50}$ (μm) | 2.71 | 3.29 | 2.54 | 1.96 | 4.10 |
| CV value (%) | 19.3 | 19.6 | 22.7 | 24.6 | 22.7 |
| Step (D) | | | | | |
| Coalescing temperature (° C.) | — | 89 | — | 85 | — |
| Coalescing time (h) | — | 1 | — | 0.67 | — |
| $D_{50}$ (μm) | — | 3.29 | — | 2.05 | — |
| CV value (%) | — | 19.8 | — | 26.2 | — |

Note:
*1 4.6 wt % $(NH_4)_2SO_4$ aqueous solution
*2: In the step (2) of Example 7, the retention time after the first addition was 15 min, and the retention time after the second addition was 60 min.
*3: In the step (2) of Example 8, the dispersion of resin-containing fine particles was first added at one time, and then the aqueous aggregating agent solution was added for 15 min.
*a D1: dispersion 1; D2: dispersion 2; D3: dispersion 3; D4: dispersion 4
*b Only the dispersion of resin-containing fine particles was added.
*c Added separately from each other but at the same time.
*d Added alternately.

What is claimed is:

1. A process for producing a toner, said process comprising:

(A) finely dispersing a resin binder in an aqueous medium in the presence of a nonionic surfactant to prepare a first dispersion of resin binder-containing fine particles;

(B) aggregating the resin binder-containing fine particles obtained in (A) together to prepare a dispersion of mother particles;

(C) adding a second dispersion of a resin binder-containing fine particles at one time or sequentially in several divided parts to the dispersion of the mother particles obtained in (B) to prepare aggregated particles thereof; and (D) coalescing the aggregated particles obtained in (C) to form toner particles;

wherein the first dispersion of resin binder-containing fine particles and the second dispersion of resin binder-containing fine particles may be the same or different; and the toner particles have a volume median particle size of 1 to 4 μm.

2. The process according to claim 1, wherein when adding the second dispersion of the resin binder-containing fine particles sequentially in several divided parts to the dispersion of the mother particles in (C), the second or subsequent part of the second dispersion of the resin binder-containing fine particles is added along with an aggregating agent in which the resin binder-containing fine particles and the aggregating agent are added separately from each other but at the same time, or added alternately.

3. The process according to claim 1, wherein the resin binder comprises a polyester.

4. The process according to claim 1, wherein in (A), the first dispersion of the resin binder-containing fine particles comprises a colorant.

5. The process according to claim 1, wherein an amount of the resin binder-containing fine particles added in (C) is from 15 to 75% by weight on the basis of a total amount of the resin binder-containing fine particles and the mother particles contained in the dispersion of the mother particles.

6. The process according to claim 1, wherein in (C), the second dispersion of the resin binder-containing fine particles is added sequentially in 2 to 6 separate parts.

7. The process according to claim 1, wherein when adding the second dispersion of the resin binder-containing fine particles sequentially in several divided parts to the dispersion of the mother particles in (C), the second or subsequent part of the resin binder-containing fine particles is added along with an aggregating agent.

8. The process according to claim 1, wherein particles of the toner have a variation coefficient of particle size distribution (CV value) of 23% or less.

9. A toner which is produced by the process as defined in claim 1.

10. The process according to claim 1, wherein the resin binder comprises 80% by weight of more of one or more polyesters.

11. The process according to claim 1, wherein in (A), water may be added after or during neutralization of a part or whole of the resin binder.

12. The process according to claim 1, wherein after (A), the volume median particle size of the resin binder-containing fine particles is 0.05 to 0.5 μm.

13. The process according to claim 1, wherein the volume median particle size of the toner is from 1 to 3 μm.

14. The process according to claim 1, wherein the volume median particle size of the resin binder-containing fine particles in (A) is 0.05 to 2 μm.

15. The process according to claim 1, wherein the volume median particle size of the resin binder-containing fine particles in (C) is 0.05 to 2 μm.

16. A method of controlling a particle size of a toner, said method comprising finely dispersing a resin binder in an aqueous medium in the presence of a nonionic surfactant to prepare a first dispersion of resin binder-containing fine particles; aggregating the resin binder-containing fine particles to prepare a dispersion of mother particles; then adding a second dispersion of a resin binder-containing fine particles at one time or sequentially in several divided parts to the dispersion of the mother particles to prepare aggregated particles thereof; and coalescing the aggregated particles; wherein the first dispersion of resin binder-containing fine particles and the second dispersion of resin binder-containing fine particles may be the same or different; and the volume median particle size of the toner is from 1 to 4 μm.

* * * * *